US006882736B2

(12) United States Patent
Dickel et al.

(10) Patent No.: US 6,882,736 B2
(45) Date of Patent: Apr. 19, 2005

(54) METHOD FOR OPERATING A HEARING AID OR HEARING AID SYSTEM, AND A HEARING AID AND HEARING AID SYSTEM

(75) Inventors: Thomas Dickel, Buttenheim (DE); Benno Knapp, Eriangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 172 days.

(21) Appl. No.: 09/951,815

(22) Filed: Sep. 12, 2001

(65) Prior Publication Data

US 2002/0037088 A1 Mar. 28, 2002

(30) Foreign Application Priority Data

Sep. 13, 2000 (DE) ..... 100 45 197

(51) Int. Cl.[7] ..... H04R 25/00

(52) U.S. Cl. ..... 381/317; 381/94.5; 381/312; 381/313; 381/318

(58) Field of Search ..... 381/92, 94.5, 94.7, 381/312, 313, 317, 318, 316, 321, 320

(56) References Cited

U.S. PATENT DOCUMENTS

| | | | | |
|---|---|---|---|---|
| 5,463,694 A | | 10/1995 | Bradley et al. | |
| 5,524,056 A | * | 6/1996 | Killion et al. | 381/314 |
| 5,793,875 A | * | 8/1998 | Lehr et al. | 381/313 |
| 5,917,921 A | * | 6/1999 | Sasaki et al. | 381/94.1 |
| 5,933,506 A | * | 8/1999 | Aoki et al. | 381/151 |

FOREIGN PATENT DOCUMENTS

| | | |
|---|---|---|
| DE | OS 44 26 967 | 7/1994 |
| WO | WO 00/02419 | 1/2000 |

* cited by examiner

*Primary Examiner*—Suhan Ni
(74) *Attorney, Agent, or Firm*—Schiff Hardin LLP

(57) ABSTRACT

In a method for operating a hearing aid or hearing aid system, and a hearing aid or hearing aid system, wind noises are detected by analyzing the output signals of at least two microphones. If wind noises are present, the signal processing unit of the hearing aid or hearing aid system and/or the signal paths of microphones are adapted in order to reduce such noises.

20 Claims, 2 Drawing Sheets

METHOD FOR OPERATING A HEARING AID OR HEARING AID SYSTEM, AND A HEARING AID AND HEARING AID SYSTEM

BACKGROUND OF THE INVENTION

1. Field of the Invention

The invention relates to a method for operating a hearing aid, as well as to a hearing aid system with at least two microphones and a signal processing unit.

2. Description of the Prior Art

Wind frequently causes unpleasant disturbing noises for the wearer of a hearing aid. In order to reduce such wind noise, it is known to fit the microphone openings so as to protect them from the wind as much as possible. It is also known to provide hearing aid microphones with a diaphragm in order to reduce instances of turbulence caused by wind. Such measures are disclosed, for example, in PCT Application WO 00/02419 and German PS 44 26 967.

German PS 44 98 516 discloses a directional gradient microphone system and a method for operating it employing three microphones and a processor. Owing to the arrangement of the three microphones on a common axis, it is only sound waves incident in the direction of the common axis which are processed after being converted into electric signals, whereas sound waves caused by wind noises, for example, after being converted into electric signals, virtually no longer occur in the output signal of the directional gradient microphone system. This known directional gradient microphone system has the disadvantage, however, that it is possible to suppress wind noises only in conjunction with a strong directional dependence in the reception of incoming sound waves.

It is a disadvantage in known hearing aids that success in removing wind noises is therefore frequently inadequate.

SUMMARY OF THE INVENTION

It is an object of the present invention to provide a method for operating a hearing aid or hearing aid system, and a hearing aid or hearing aid system, wherein the comfort in wearing the hearing aid or hearing aid system in windy surroundings is improved.

The above object is achieved in accordance with the principles of the present invention and that a hearing aid arrangement, such as a hearing aid or a hearing aid system, and a method for operating a hearing aid arrangement, wherein these two microphones are provided in the hearing aid arrangement, and wherein respective signals from the microphones are analyzed to detect whether winded noises are present, and wherein one or more measures for reducing the winded noises are activated automatically if winded noises are detected.

In contrast to known approaches to the avoidance of wind noises, in which an attempt is made to avoid the wind noises by external measures at the hearing aid, the invention adopts the approach of detecting and removing wind noises by electronic signal processing. This has the advantage that the microphones of the hearing aid can be placed in the housing so as to ensure the best possible reception of the useful signals, nor is there any need to fit an additional diaphragm, which causes undesired damping of the useful signal. The output signals of at least two microphones are analyzed in order to detect wind noises. The microphones in this case can be located in a hearing aid, but it is also possible to evaluate microphone signals of a hearing aid system (consisting, for example, of two hearing aids for one binaural supply).

The invention is distinguished in that measures for avoiding wind noises are not taken until wind noises are actually present. In order to detect wind noises, the invention utilizes the effect that there is a high degree of correlation between the microphone signals generated by the spatially separate microphones of a hearing aid or hearing aid system, which are caused by useful sound, indeed even by noise. By contrast, wind noises are generated chiefly by instances of turbulence at the microphone openings. The microphone signals caused by wind of a number of microphones therefore are uncorrelated to a high degree. This difference is exploited advantageously for the purpose of detecting wind noises.

In an embodiment of the inventive method, in order to determine the correlation of microphone signals of different microphones, the microphone signals are subtracted from one another. The higher the degree of correlation between the microphone signals, the lower the result of the subtraction will be, on average. The values which are obtained on average by subtracting two microphone signals therefore constitute a measure of the correlation of the microphone signals. A simple smoothing can be carried out in this case as a simple way of averaging the result of the subtraction. This can be implemented, for example, by low pass filtering. In order to decide whether the microphone signals constitute wind noises, the result of the subtraction, preferably after smoothing, is compared with a threshold value. If the smoothed signal overshoots the threshold value, wind noises are deemed to be present. It is therefore possible to initiate signal processing measures yet to be explained. If the threshold value is not reached, there is no need for measures to reduce wind noises.

In order to avoid frequently switching the status of the signal processing unit, in an embodiment of the method of the invention, measures for reducing wind noises are not activated or deactivated until the threshold value is continuously overshot, respectively, or undershot for a specific period of time.

Furthermore, in another embodiment of the inventive method, two threshold values are determined which must be continuously overshot or undershot for a specific period of time in order to switch the signal processing unit. This prevents frequent switching of the signal processing unit of the hearing aid in the event of wind noises which are just on the threshold of detection as such. The two threshold values therefore form a type of hysteresis in the detection of wind noises.

In order to determine the correlation between two or more signals, in addition to the above-described method, still further methods are known which can be used within the scope of the invention to determine the correlation between microphone output signals. However, the above-described method constitutes a version which is particularly simple to implement.

If wind noises have been established by an analysis of the microphone signals, suitable measures are to be taken in the processing of the microphone signals such that the wind noises are reduced. Examples of such measures are outlined below:

A suitable measure for suppressing wind noises is to switch microphone system of the hearing aid from a directional model to an omnidirectional mode. Specifically, directional microphone systems react more sensitively to wind than non-directional microphone systems. Certainly, directional action of the hearing aid is worsened by this measure, but the wind noises nevertheless are reduced.

Another measure for reducing detected wind noises is to filter the microphone signals. Use is made for this purpose of the fact that the disturbing noises caused by wind are situated predominantly in the low frequency band. Low frequencies can be damped by appropriate high pass filtering, and the wind noises thus can be effectively suppressed. The hearing aid is therefore put into a type of "tweeter operating mode", in which, essentially, only higher-frequency signal components of the microphone signals are further processed and amplified.

A further measure as a reaction to detected wind noises is to adapt the acting times of the AGC (Automatic Gain Control). Since wind noises are very different as regards both the temporal sequence and the loudness level, these constitute a significant problem in automatic control processes within the signal processing of a hearing aid such as, for example, the Automatic Gain Control (AGC). It is therefore expedient to select time constants which are as long as possible in the corresponding acting times. A relatively long response and decay time of AGC can therefore be set as reaction to detected wind noises.

A further measure is implemented in the further processing, whereby similar only signal components of the output signals of at least two microphones are further processed for reducing detected wind noises. Only signal components of output signals which emanate from one microphone are filtered out. The filtering can be performed, for example, by means of a subtraction filter. As in the above-described method for detecting wind noises, the invention also takes advantage in this case of the fact that the signal components caused by wind in microphone output signals are largely uncorrelated and therefore do not emanate in the same form from any further microphone. If only those signal components are further processed which essentially emanate in a similar way from a number of microphones, the wind noises are largely eliminated.

In addition to the above-identified individual measures for reducing wind noises, arbitrary combinations of these measures can be used in accordance with the invention. These also can vary; depending on the frequency and loudness level of the wind noises.

The invention can be employed in the case of all current types of hearing aids such as, for example, in hearing aids worn behind the ear, in hearing aids worn in the ear, in implantable hearing aids or in pocket aids. Electroacoustic transducers come into consideration as input transducers, while electromechanical, electromagnetic or electric transducers (for example for directly stimulating hearing cells) also come into consideration as output transducers. Furthermore, a hearing aid system formed by a number of aids, such as a hearing aid system with two hearing aids worn on the head for the purpose of binaural supply, also can be used. The microphone signals which are analyzed in order to detect wind noises then also can emanate from different aids.

Furthermore, the measures for reducing detected wind noises are not limited to the variation of parameters of the signal processing unit. Thus, for example, as reactions to detected wind noises it is also possible to switch off microphones, to vary the cross section of sound inlets of microphones, or to open or close sound inlets of microphones.

DESCRIPTION OF THE PREFERRED EMBODIMENTS

Figure 1:
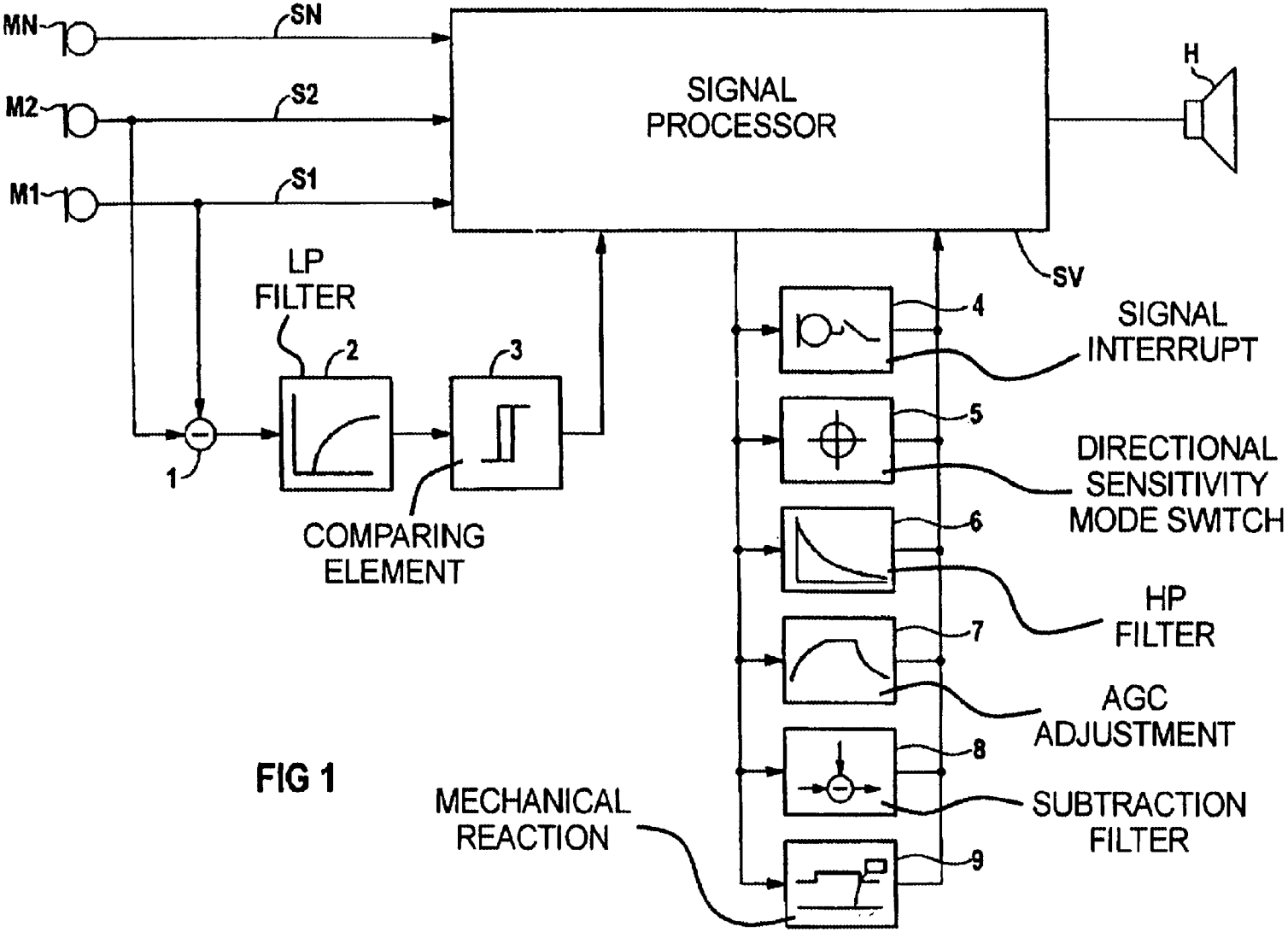
FIG. 1 is a schematic block diagram of a hearing aid in which wind noises are detected and reduced, constructed and operating in accordance with the invention.

FIG. 1 shows schematically in a hearing aid the signal processing for detecting and reducing wind noises. The hearing aid has a number of microphones M1, M2, . . . , MN for converting acoustic signals into electric signals, a signal processing unit SV and an earphone H for converting electric signals into acoustic signals. Two of the microphone signals S1, S2 are tapped and fed to a difference element 1. The absolute value of the difference between the output signals S1, S2 of the microphones M1 and M2 is formed in the difference element 1. The difference signal is fed for the purpose of averaging to a low pass filter 2, illustrated in FIG. 1 by the typical step response of a low pass filter. The low pass filter 2 causes smoothing of the difference signal. In the further course of the signal the smoothed signal is compared to two threshold values in the comparing element 3. Wind noises are deemed to be present if the smoothed signal overshoots a threshold value T1. Wind noises are deemed not to be present if the smoothed signal undershoots a threshold value T2. In the event of the presence of wind noises, the signal processing unit SV of the hearing aid automatically takes measures to reduce these wind noises. If the smoothed signal is situated between the two threshold values T1 and T2, the previous state of the hearing aid is maintained, i.e. if measures to reduce wind noises are currently active, these remain active, while if no measures for reducing wind noises are currently active, none are activated for the moment.

The hearing aid can react to detected wind noises in multiple ways shown by example below, the automatic control being performed by means of the signal processing unit SV:

In a first measure 1 for reducing wind noises in the hearing aid in accordance with the exemplary embodiment with the exception of the microphones M1, M2 required for detecting wind noises, the microphones M3, M4 . . . , MN are switched off. This is illustrated graphically in FIG. 1 by the symbol 4, which shows an interrupted microphone signal path.

A further measure is to vary the directional characteristic of the hearing aid. This option is based on the finding that directional microphone systems react more sensitively to wind than omnidirectional microphone systems do. This measure is illustrated in FIG. 1 by means of the directional characteristics of an omnidirectional microphone in the form of a circle in accordance with symbol 5.

Furthermore, the noises caused by wind are situated predominantly in the low frequency, audible frequency band. Consequently, another measure for reducing noises caused by wind is high pass filtering. FIG. 1 shows, for this purpose, in symbol 6 the typical step response of a high pass filter.

In hearing aids, disturbances caused by wind in a secondary fashion can occur in addition to the disturbances caused in a primary fashion in the form of wind noises. Such disturbances relate, in particular, to automatically proceeding control and adaptation processes of the signal processing of the hearing aid. AGC (Automatic Gain Control) may be named for this by way of example. Because of the output signals of the microphones, this automatic gain control tries to cause operation of a situation-dependent setting of the loudness level control of the hearing aid, in particular reduction of the gain in the case of very loud input levels. Since wind noises differ strongly from one another with reference to their loudness level and their duration, and the period of time between successive wind noises can vary strongly, because of the wind noises the internal AGC of the hearing aid will change the loudness level setting of the hearing aid very frequently. This leads to a "pumping effect" which is unpleasant to the wearer of a hearing aid. The response and delay times of the AGC are lengthened in the event of detected wind noises as a measure against this effect. The reaction times of the AGC are slowed down thereby. This is illustrated in FIG. 1 by the symbol 7 which represents the response and delay time of the AGC.

A further measure for reducing detected wind noises is the application of a subtraction filter. Such a subtraction filter ensures that, of the signal components of the output signals of a number of microphones, only those signal components which emanate equally from all these microphones are further processed and fed to the earphone H. Uncorrelated wind noises which emanate from only one microphone in each case are suppressed. The graphic illustration of this is represented by the symbol 8 in FIG. 1, which shows a difference element, and thus a substantial constituent of a subtraction filter.

Measures of a mechanical nature are also conceivable in addition to the previously described measures, which chiefly relate to signal processing. Thus, sound channels to the microphones can be automatically narrowed or closed, or wind shields can be flapped open or aligned in front of the microphone openings. These measures are illustrated in FIG. 1 by the symbol 9, which shows a sound channel with a motor-actuated flap.

In the event of detected wind noises, in the hearing aid in accordance with the invention the above-described measures can be carried out for the purpose of reducing the wind noises individually or in an arbitrary combination, including as a function of the level and frequency of the wind noises occurring.

Figure 2:
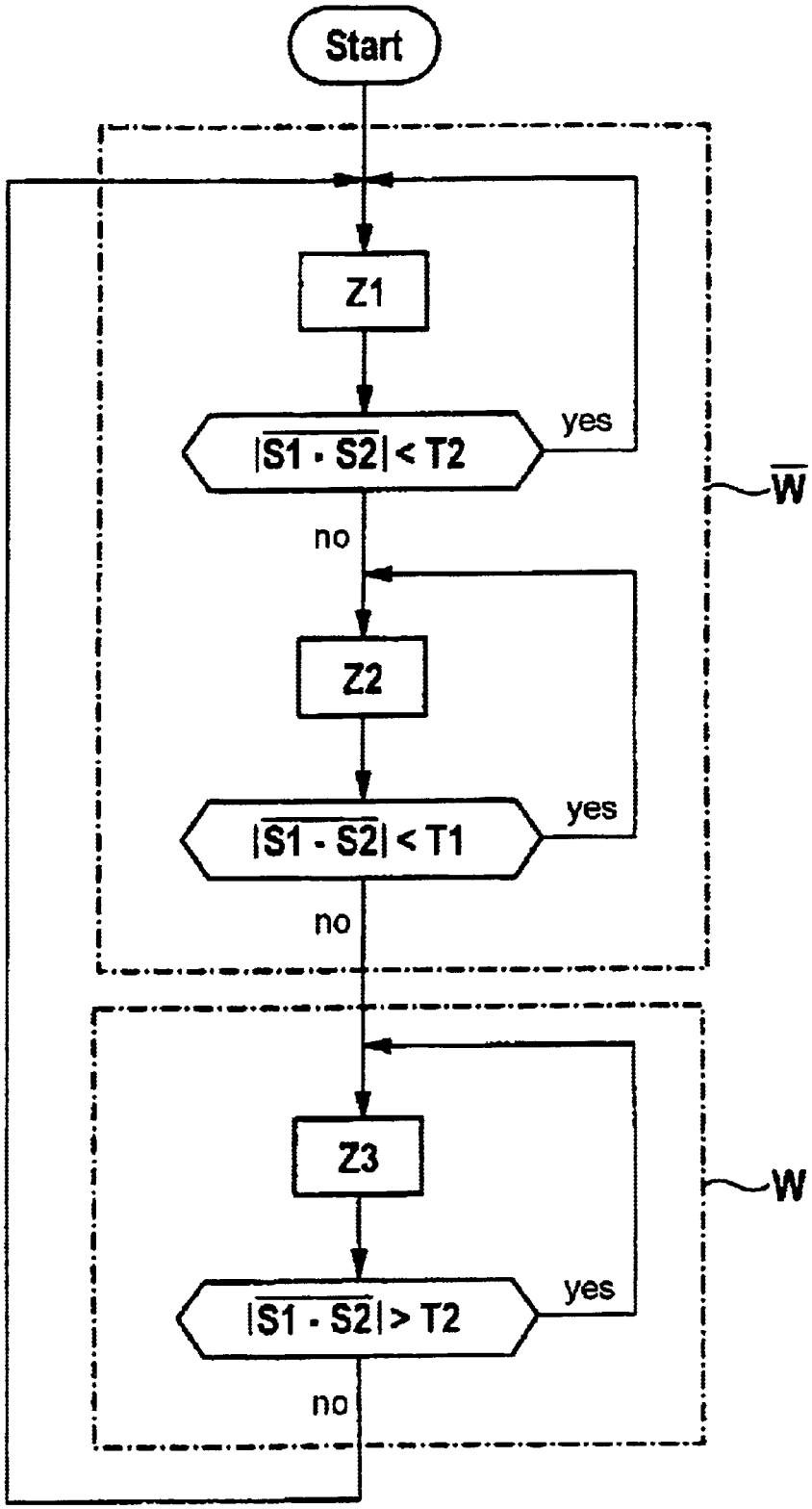
FIG. 2 shows an embodiment of the inventive method for detecting wind noises in the form of a flowchart.

FIG. 2 shows a flowchart of the signal processing of a hearing aid for the purpose of detecting wind noises. After the hearing aid is switched on (start), it is firstly transferred into a state Z1. The signal processing remains in this state until the averaged difference signal $\overline{|s1-s2|}$, corrected for sign, of two microphone signals S1, S2 undershoots a threshold value T2. If the difference signal overshoots the threshold value T2, the signal processing is transferred into a state Z2. The signal processing remains in this state until the difference signal undershoots a threshold value T1. If the difference signal overshoots the threshold value T1, the signal processing passes into the state Z3. It remains in the state Z3 until the difference signal overshoots the threshold value T2. It is transferred into the output state Z1 again in the event of undershooting the threshold value T2.

In the flowchart in accordance with FIG. 2, the states Z1 and Z2 signify "no wind" ($(\overline{W})$), and the state Z3 signifies "wind" (W). In state Z3 ("wind"), suitable measures, for example those named above, can be taken to reduce the detected wind noises.

In the event of the detection of wind noises, the indicated cycle of signal processing with the two threshold values T1 and T2 results in a hysteresis which prevents very frequent switching over of the hearing aid between the operating states of "wind" and "no wind". A further measure for preventing frequent switching over is formed by the invention in that the states Z1 to Z3 are changed only when the difference signal continuously overshoots or undershoots the threshold values for a specific period of time which can be set.

We claim as our invention:

1. A method for operating a hearing aid arrangement comprising:

picking up incoming audio signals, subject to wind noises with at least two microphones, and generating respective microphone signals in said at least two microphones;

analyzing said microphone signals to detect whether wind noises are present; and if wind noises are detected in said microphone signals, automatically switching said at least two microphones from operation in a directional mode to operation in an omni-directional mode for reducing said wind noises.

2. A method as claimed in claim 1 wherein the step of automatically activating a measure for reducing said wind noises comprises filtering said microphone signals.

3. A method as claimed in claim 1 wherein the step of automatically activating a measure for reducing said wind noises comprises processing said microphone signals in a tweeter operating mode.

4. A method as claimed in claim 1 comprising processing said microphone signals using automatic gain control, and wherein the step of automatically activating a measure for reducing said wind noises comprises changing acting times of said automatic gain control.

5. A method as claimed in claim 1 comprising disposing said at least two microphones in a housing having respective microphone openings for said microphones and respective sounded channels associated with said microphones, and wherein the step of automatically activating a measure for reducing said wind noises comprises reducing a size of at least one of said microphone openings and said sound channels.

6. A method for operating a hearing aid arrangement comprising:

picking up incoming audio signals, subject to wind noises, with at least two microphones and generating respective microphone signals in said at least two microphones;

correlating said microphone signals by subtracting one of said microphone signals from another of said microphone signals to obtain a different signal indicative of a degree of correlation of said microphone signals;

smoothing said difference signal to obtain a smoothed difference signal;

comparing said smoothed difference signal to at least one threshold value and determining whether wind noises are present in said microphone signals dependent on a relationship of said smoothed difference signal to said at least one threshold value; and if wind noises are detected in said microphone signals, automatically activating a measure for reducing said wind noises.

7. A method as claimed in claim 6, comprising determining wind noises are present in said microphone signals if said smoothed difference signal exceeds a first threshold value.

8. A method as claimed in claim 7 comprising determining that wind noises are present in said microphone signals if said smoothed difference signal exceeds said first threshold value for a predetermined period of time.

9. A method as claimed in claim 7 comprising determining that wind noises are not present in said microphone signals when said smoothed difference signal falls below a second threshold value.

10. A method as claimed in claim 9 comprising determining that wind noises are not present in said microphone signals when said smoothed difference signal falls below said second threshold value for a predetermined period of time.

11. A hearing aid arrangement comprising:

at least two microphones for respectively picking up incoming audio signals, subject to wind noises, said at least two microphones generating respective microphone signals;

circuitry for analyzing said microphone signals to detect whether wind noises are present, said circuitry including a processor; and if wind noises are detected in said microphone signals, said processor automatically switching said at least two microphones from operation in a directional mode to operation in an omni-directional mode for reducing said wind noises.

12. A hearing aid arrangement as claimed in claim 11 comprising a filter and wherein said processor automatically activates said measure for reducing said wind noises comprises by filtering said microphone signals in said filter.

13. A hearing aid arrangement as claimed in claim 11 wherein said processor automatically activates said measure for reducing said wind noises by processing said microphone signals in a tweeter operating mode.

14. A hearing air arrangement as claimed in claim 11 comprising an automatic gain control circuit for processing said microphone signals using automatic gain control, and wherein said processor automatically activates said measure for reducing said wind noises by changing acting times of said gain control.

15. A hearing aid arrangement as claimed in claim 11 comprising a housing having respective microphone openings for said at least two microphones and the respective sounded channels associated with said microphones, and wherein said processor automatically activates said measure for reducing said wind noises by activating a mechanical element to reduce a size of at least one of said microphone openings and said sound channels.

16. A hearing aid arrangement comprising:

at least two microphones for respectively picking up incoming audio signals, subject to wind noises, said at least two microphones generating respective microphone signals;

a signal processor supplied with said microphone signals for correlating said microphone signals by subtracting one of said microphone signals from another of said microphone signals to obtain a difference signal indicative of a degree of correlation of said microphone signals, and for smoothing said difference signal to obtain a smooth difference signal, and for comparing said smooth difference signal to at least one threshold value and for determining whether wind noises are present in said microphone signals dependent on a relationship of said smooth difference signal to said at least one threshold value; and if wind noises are detected in said microphone signals, said signal processor automatically activating a measure for reducing said wind noises.

17. A hearing aid arrangement as claimed in claim 16 wherein said processor determines wind noises are present in said microphone signals if said smoothed difference signal exceeds a first threshold value.

18. A hearing aid arrangement as claimed in claim 17 wherein said processor determines that wind noises are present in said microphone signals if said smoothed difference signal exceeds said first threshold value for a predetermined period of time.

19. A hearing aid arrangement as claimed in claim 17 wherein said processor determines that wind noises are not present in said microphone signals when said smoothed difference signal falls below a second threshold value.

20. A hearing aid arrangement as claimed in claim 19 wherein said processor determines that wind noises are not present in said microphone signals when said smoothed difference signal falls below said second threshold value for a predetermined period of time.

* * * * *